US009573018B2

(12) United States Patent
MacColl et al.

(10) Patent No.: US 9,573,018 B2
(45) Date of Patent: Feb. 21, 2017

(54) EXERCISE DEVICE

(71) Applicant: Implus Footcare, LLC, Durham, NC (US)

(72) Inventors: Ian Coats MacColl, Mill Valley, CA (US); Kurin V. Tu, San Mateo, CA (US); Zachary M. Goldberg-Poch, San Francisco, CA (US); Alden Morris Mills, Kentfield, CA (US)

(73) Assignee: IMPLUS FOOTCARE, LLC, Durham, NC (US)

( * ) Notice: Subject to any disclaimer, the term of this patent is extended or adjusted under 35 U.S.C. 154(b) by 42 days.

(21) Appl. No.: 14/525,612

(22) Filed: Oct. 28, 2014

(65) Prior Publication Data

US 2016/0082313 A1 Mar. 24, 2016

Related U.S. Application Data

(60) Provisional application No. 62/052,659, filed on Sep. 19, 2014.

(51) Int. Cl.
*A63B 71/00* (2006.01)
*A63B 23/02* (2006.01)
(Continued)

(52) U.S. Cl.
CPC ..... *A63B 23/0211* (2013.01); *A63B 21/00047* (2013.01); *A63B 21/068* (2013.01); *A63B 23/0233* (2013.01); *A63B 23/1236* (2013.01)

(58) Field of Classification Search
CPC ..... A63B 21/0004; A63B 21/00072; A63B 21/00076; A63B 21/00185; A63B 21/0615; A63B 21/065; A63B 21/068; A63B 21/078; A63B 21/159; A63B 21/4023; A63B 21/4025; A63B 21/4027; A63B 21/4029; A63B 21/4031; A63B 21/4033; A63B 21/4035; A63B 21/4037; A63B 21/4039; A63B 21/4043; A63B 21/4045; A63B 21/4047; A63B 21/4049; A63B 23/0205; A63B 23/0211; A63B 23/12; A63B 23/1209; A63B 23/1227; A63B 23/1236; A63B 23/1245; A63B 23/1281; A63B 69/0057; A63B 69/0059; A63B 2208/0242; A63B 2208/0252; A63B 2208/0295; A63B 2225/10
See application file for complete search history.

(56) References Cited

U.S. PATENT DOCUMENTS

D286,802 S * 11/1986 Ahlberg ..... D21/688
5,125,650 A * 6/1992 Paris ..... A63B 21/00047 482/140
(Continued)

*Primary Examiner* — Stephen Crow
*Assistant Examiner* — Gary D Urbiel Goldner
(74) *Attorney, Agent, or Firm* — Buchanan Ingersoll & Rooney PC

(57) ABSTRACT

The exercise device described herein includes a pair of roll bars in spaced parallel relation thereto and having first and second ends, each roll bar having a curved portion configured to contact a ground surface for performing selected exercises. A handle bar is connected to the roll bars' first ends. A head bar is provided, a portion of which contacts the ground surface, and include a pair of spaced connector arms that extend above the ground surface with ends thereof connected to the roll bars' second ends, forming side rails in spaced parallel relation. The side rails are canted from the roll bars to the head bar at an upward angle relative to the ground surface. A singular material canopy is attached to the head bar and side rails for supporting the head, neck, shoulders, and upper back of a user during selected exercises.

19 Claims, 7 Drawing Sheets

(51) Int. Cl.

| | |
|---|---|
| ***A63B 21/068*** | (2006.01) |
| ***A63B 23/12*** | (2006.01) |
| ***A63B 21/00*** | (2006.01) |

(56) References Cited

U.S. PATENT DOCUMENTS

| | | | | | |
|---|---|---|---|---|---|
| 5,492,520 | A | | 2/1996 | Brown | |
| 5,545,114 | A | * | 8/1996 | Gvoich | A63B 21/4011 482/123 |
| 5,577,987 | A | | 11/1996 | Brown | |
| 5,630,778 | A | | 5/1997 | Barreca | |
| D379,836 | S | | 6/1997 | Chen | |
| D380,517 | S | | 7/1997 | Ho | |
| D384,379 | S | | 9/1997 | Lin | |
| D385,930 | S | | 11/1997 | Chen | |
| 5,779,607 | A | * | 7/1998 | Harris | A63B 21/0004 482/131 |
| 5,813,957 | A | * | 9/1998 | Rossiter | A63B 23/0211 441/129 |
| D404,432 | S | | 1/1999 | Sands | |
| 5,871,425 | A | * | 2/1999 | Gvoich | A63B 21/4011 482/123 |
| 5,931,768 | A | * | 8/1999 | Amesquita | A63B 23/0211 482/140 |
| 5,941,806 | A | * | 8/1999 | Olschansky | A63B 23/0222 482/132 |
| 6,117,057 | A | | 9/2000 | Olschansky et al. | |
| 6,203,473 | B1 | * | 3/2001 | Atwood | A63B 21/00047 482/142 |
| 7,207,932 | B1 | * | 4/2007 | Dean | A63B 23/0211 482/140 |
| 8,002,683 | B1 | | 8/2011 | Nayebdadash | |
| D659,207 | S | | 5/2012 | Brown | |
| 2002/0025895 | A1 | * | 2/2002 | Sanchez | A63B 21/06 482/140 |
| 2003/0100415 | A1 | | 5/2003 | Augustine et al. | |
| 2004/0147380 | A1 | * | 7/2004 | Mattox | A63B 21/0004 482/139 |
| 2006/0217246 | A1 | | 9/2006 | Payne | |
| 2006/0234844 | A1 | * | 10/2006 | Kates | A63B 23/0211 482/140 |
| 2007/0099778 | A1 | * | 5/2007 | Ko | A63B 22/14 482/146 |
| 2008/0108487 | A1 | * | 5/2008 | Bizzell | A63B 21/0004 482/142 |
| 2010/0160126 | A1 | * | 6/2010 | Nardone | A63B 21/0004 482/140 |
| 2010/0292058 | A1 | * | 11/2010 | Barnes | A63B 21/00 482/139 |
| 2012/0065038 | A1 | | 3/2012 | Nayebdadash | |
| 2012/0071307 | A1 | * | 3/2012 | Russillo | A63B 21/0004 482/140 |
| 2012/0190517 | A1 | * | 7/2012 | Scott | A63B 21/4029 482/142 |
| 2014/0287881 | A1 | * | 9/2014 | Wallisch | A63B 3/00 482/41 |

* cited by examiner

EXERCISE DEVICE

CROSS-REFERENCE TO RELATED APPLICATION

The present application claims the benefit under 35 U.S.C. §119(e) of U.S. Provisional Patent Application No. 62/052,659 to Ian C. MacColl et al., filed Sep. 19, 2014, the entire contents of which is hereby incorporated by reference herein.

BACKGROUND

Field

The example embodiment in general is directed to an exercise device, more particularly to an exercise device configurable to perform selected exercises in a first abdominal exercise configuration on a ground surface while supporting each of the head, neck, shoulders and upper back, and to perform different exercises in a second push-up/dip configuration on the ground surface.

Related Art

Various prior art systems have been devised as attempts to provide users with abdominal exercise methods. Convention abdominal exercisers include a typical rocker-type device having a frame defining a pair of u-shaped support rails that rock on a ground surface, a headrest or neck pad, often a pair of armrest portions and an upstanding arch-shaped portion (which may also serve to accommodate hand placements) connecting the u-shaped support rails together. The user lies inside the rocker-type device between the u-shaped support rails and rotates or cants forward with the device to exercise the abdominal muscles by performing sit-ups and crunches.

At least one of these known rocker-type abdominal exercisers is also configured to perform exercises other than abdominal exercises, such as push-ups (non-abdominal exercises) and dips. The commercially available AB ROLLER® exercise device by Tristar Products, Inc., is one such conventional device. FIG. 1 is perspective view of a prior art exercise device in an abdominal exercise configuration; FIG. 2 is a perspective view of the same prior art device in a second push-up/dip configuration. FIGS. 1 and 2 are provided to describe the AB ROLLER, which is illustrated in U.S. Des. Pat. No. D659,207 to Brown.

Referring to FIGS. 1 and 2, exercise device 1 includes a tubular handle bar 2 which has a pair of leg portions 3 connected to corresponding upper ends 4 of a pair of tubular, u-shaped support rails 5. In the abdominal exercise configuration of FIG. 1, curved portions 6 of the support rails 5 contact the ground surface 20, as do lower straight leg portions 7, which lie flush with the ground surface 20 in an "at rest" position of device 1. Lower ends 8 of the support rails 5 are connected to corresponding ends 9 of a head bar 10. In the at rest position, the head bar 10 lies flat on the ground surface 20, and includes a crossbar portion 11 supporting a central neck roll pad 12 thereon. Head bar 10 also includes a pair of feet 13 and a pair of upstanding pegs 14 which are configured to receive circular weights (not shown) in stacked relation thereon.

For the abdominal exercise configuration, in operation the user lays prone on his/her back between the u-shaped support rails 5 with head resting on the neck roll pad 12, and grasps the handle bar 2 by placing their hands around the foam pad 15. The user's legs are bent at the knee, feet flat on the ground surface 20. The user then may perform a sit-up or crunch exercise by rocking back and forth along the curved portions 6 of the device 1 upward towards their knees and back to the supine position. To perform push-ups and dips, the user simply flips the device 1 over so that the two feet 13 and top of the handle bar 2 contacts the ground surface 20, as shown by FIG. 2. For a push-up, the user leans forward (at an incline) with their feet on the ground and hands grasping the foam pads 15 provided on the curved portions 6 of support rails 5. The user may then perform incline pushups. To perform a dip, the user grabs the foam pads 15 on the support rails 5 so that their trunk is between the rails 5 and above the handle 2, and their legs extended straight and outward from the handle 2 with their feet or heels on the ground surface 20.

An issue with the AB ROLLER design is that there is insufficient support for the entire upper torso of the user for abdominal exercise; only part of the head and neck of the user is actually supported by the neck pad 12 on head bar 10. The limits of employing a neck pad only (and hence failing to support the shoulders and upper back) could potentially cause unwanted strain or pain to neck, shoulder and/or back muscles as the user begins initiating an upward and forward crunch/sit-up movement. For example, since the neck pad 12 supports only the neck and part of the lower rear of the head, when the user initiates an upward sit-up or crunch movement, the user's head and neck bend forward under strain, out of alignment with the shoulders and back and thus moving slightly ahead of the shoulders and back. This causes the user's chin to dip down toward the chest, placing unnecessary strain on the neck. This in turn can lead to injury.

SUMMARY

An example embodiment is directed to an exercise device. The device includes a pair of roll bars in spaced parallel relation to one another, each roll bar having first and second ends and a curved portion configured to contact a ground surface for performing selected exercises, a handle bar connected to the roll bars' first ends, and a head bar, a portion of which is configured to contact the ground surface, the head bar including a pair of spaced arms that extend above the ground surface and having ends connected to the roll bars' second ends to form a pair of side rails in spaced parallel relation. The side rails are canted from the roll bars to the head bar so as to be at an upward angle relative to the ground surface. The device further includes a singular material canopy attached to the head bar and side rails for supporting the head, neck, shoulders, and upper back of a user during selected exercises.

Another example embodiment is directed to an exercise device configurable in a first position on a ground surface to perform abdominal exercises and in a second position on the ground surface to perform push-ups and dips. The device includes a pair of roll bars in spaced parallel relation to one another, each roll bar of singular construction and including an integral upper straight portion, curved portion configured to contact the ground surface with the device in the first position, and lower straight portion that extends rearward from the curved portion at an upward inclined angle relative to the ground surface. The device further includes a handle bar of singular construction extending upward from the ground surface with the device in the first position and having an upper and lower end, with a horizontal tubular portion for receiving hand placements of a user provided at the upper end, the horizontal tubular portion curving downward at either end to form a pair of integral, straight tubular legs in spaced parallel relation to one another, a terminating end of each straight leg at the lower end of the handle bar connected to a corresponding upper straight portion of a roll bar. The device further includes a head bar of singular construction arranged rearward of the handle bar and roll bars, the head bar including a horizontal central tubular portion that contacts the ground surface with the device in the first position and which turns upward at each end to form two integral connector arms in spaced parallel relation to one another, each connector arm including a first upstanding straight portion extending in a direction toward the handle bar at an upward angle to the ground surface, a curved portion at an apex of each connector arm, and a second straight portion extending from the curved portion at a downward angle relative to the ground surface so as to be connected to a corresponding upwardly angled lower straight portion of a roll bar, the connected lower straight portions of the roll bars and second straight portions of the connector arms forming a pair of straight side rails in spaced parallel relation that are inclined upward from the curved portions of the roll bars to the curved portions of the connector arms of the head bar with the device in the first position. The device further includes a material canopy for supporting the head, neck, shoulders, and upper back of a user during an abdominal exercise movement with the device in the first position, the canopy having an upper end attached to the horizontal central tubular portion of the head bar, the canopy extending across the device between the side rails and having a lower end that terminates at the curved portions of the roll bars. With the device in the first position, the user's head, neck, shoulders, and upper back is in alignment and fully supported by the canopy as the user grasps the handle bar to initiate an abdominal exercise movement. When configured in a second position, where the device has been rotated along the ground surface so that the curved portions of the roll bars extend upward to face away from the ground surface for the user to employ as hand placements for push-up and dip exercises, the handle bar and head bar serve as contact points for the device on the ground surface.

Another example embodiment is directed to an exercise device which includes a pair of roll bars in spaced parallel relation to one another and having first and second ends, each roll bar having a curved portion configured to contact a ground surface to perform selected exercises, a handle bar connected to the roll bars' first ends, a head bar, a portion of which contacts the ground surface, the head bar including a pair of spaced arms that extend above the ground surface with ends connected to the second ends of the roll bars, forming a pair of side rails in spaced parallel relation, the side rails canted from the roll bars to the head bar at an upward angle relative to the ground surface, and a material canopy attached to the head bar and side rails for supporting the head, neck, shoulders, and upper back of a user during selected exercises.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

The example embodiment hereafter describes an exercise device configurable to perform selected exercises in a first abdominal exercise configuration on a ground surface while supporting each of the head, neck, shoulders and upper back during the exercise, and to perform different exercises with the device in a second push-up/dip configuration on the ground surface.

Figure 1:
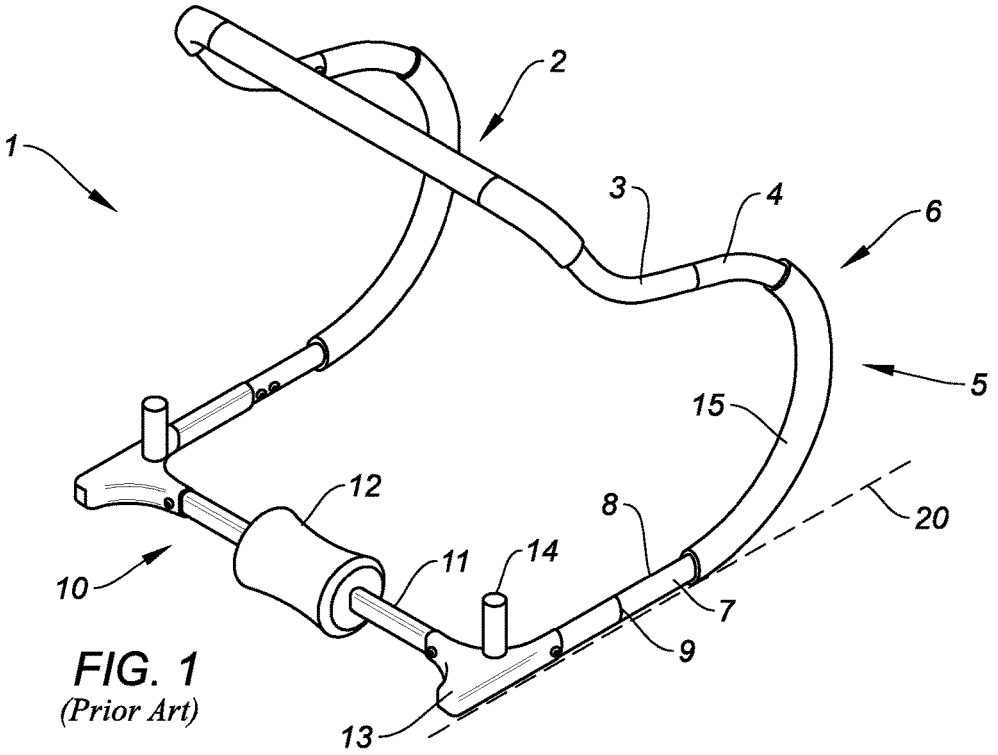
FIG. 1 (Prior Art)
FIG. 1 is perspective view of a prior art exercise device in an abdominal exercise configuration.
Figure 2:
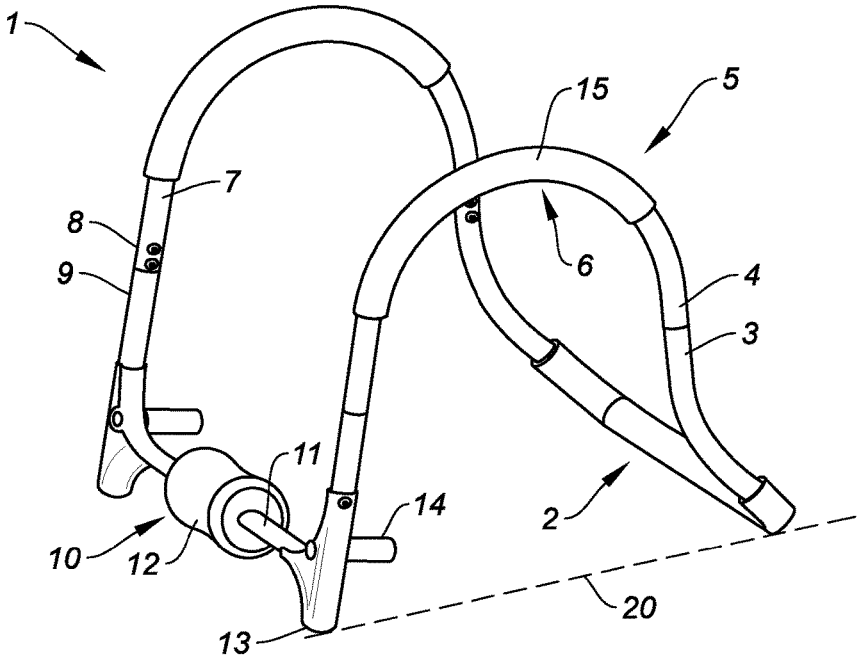
FIG. 2 (Prior Art)
FIG. 2 is a perspective view of the same prior art device in a second push-up/dip configuration.
Figure 3:
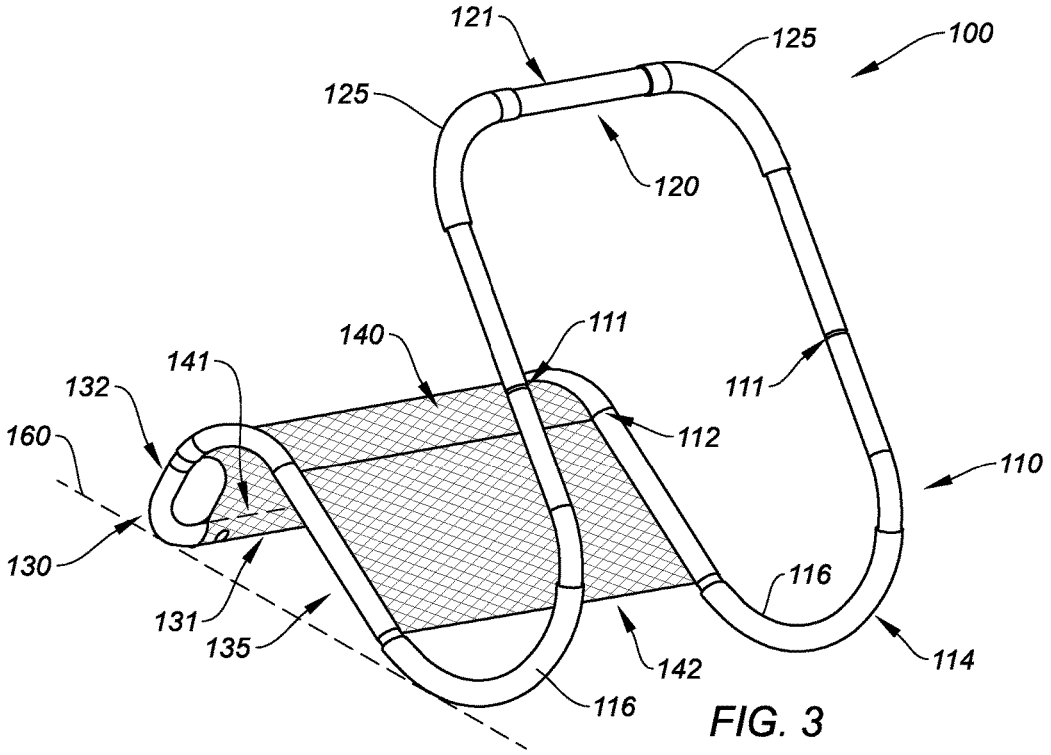
FIG. 3 is a perspective view of an exercise device in an abdominal exercise configuration, in accordance with an example embodiment.
Figure 4:
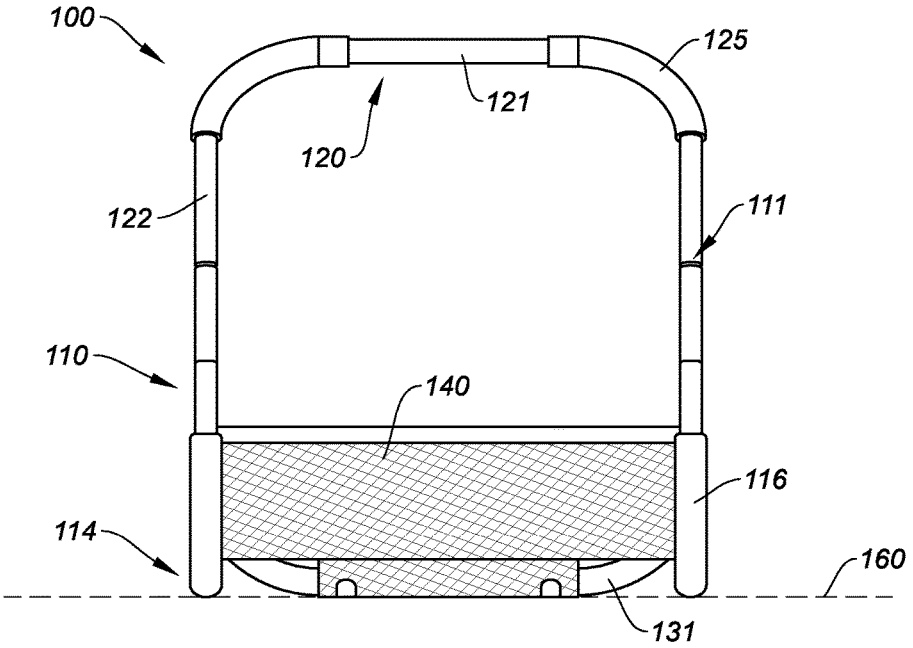
FIG. 4 is a front view of the device shown in FIG. 3.
Figure 5:
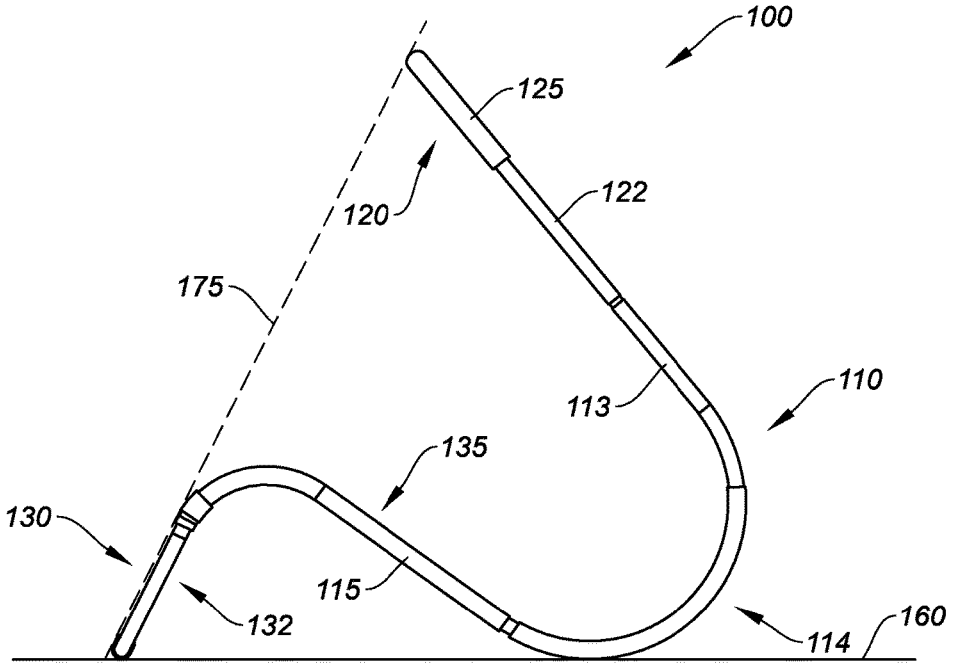
FIG. 5 is a right-side view of the device of FIG. 3 in a first abdominal exercise configuration, the left-side view being a mirror image of the right-side view.
Figure 6:
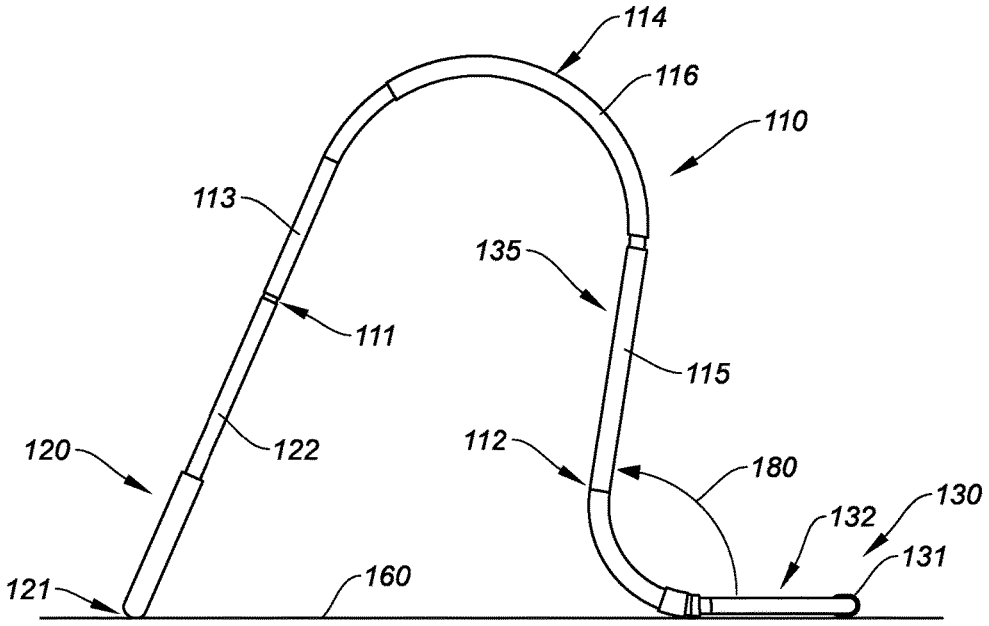
FIG. 6 is a right-side view of the device of FIG. 3 as rotated into a second push-up/dip exercise configuration, the left-side view being a mirror image of the right-side view.

FIG. 3 is a perspective view of an exercise device in an abdominal exercise configuration, in accordance with an example embodiment; FIG. 4 is a front view of the device shown in FIG. 3; FIG. 5 is a right-side view of the device of FIG. 3 in a first abdominal exercise configuration, the left-side view being a mirror image of the right-side view; and FIG. 6 is a right-side view of the device of FIG. 3 as rotated into a second push-up/dip exercise configuration, the left-side view being a mirror image of the right-side view. Referring to FIGS. 3-6, an exercise device 100 is described and includes a pair of tubular roll bars 110 in spaced parallel relation to one another. Each roll bar 110 has a first end 111, a second end 112 (obscured in FIGS. 3-6 by a material canopy 140) and a curved portion 114 configured to contact a ground surface 160 for performing selected exercises.

Device 100 includes a tubular handle bar 120. Handle bar 120 includes a horizontal tubular portion 121 which turns downward at its ends to form integral straight leg portions 122 in equal spaced relation to one another, which in turn are connected to an upper straight portion 113 of a corresponding roll bar 110 at its first end 111 thereof. Handle bar 120 is provided for hand placements by the user for performing abdominal exercises with the device 100 in a first exercise position; the horizontal portion 121 at its upper end may include grips 125 thereon (foam, rubber, plastic, etc.) for hand placements.

Device 100 further includes a tubular head bar 130 that is positioned rearward of the roll bars 110 and handle bar 120. As can be seen in FIG. 3, a portion (such as a horizontal tubular central portion 131) of the head bar 130 is configured to contact the ground surface 160. The head bar 130 has a pair of spaced connector arms 132 integral with the horizontal tubular central portion 131 and which extend above the ground surface 160. The connector arms 132 include ends (obscured by a canopy 140) that are connected to the second ends 112 (obscured by canopy 140) of the roll bars 110 so as to collectively form a pair of side rails in spaced parallel relation, shown generally by element 135. The side rails 135 are canted from the curved portions 114 of the roll bars 110 to the head bar 130 so as to be at an upward angle relative to the ground surface 160.

The device 100 further includes the singular material canopy 140 of the described figures. Canopy 140 is attached at an upper end 141 thereof to the head bar 130 and includes sides 143 secured to side rails 135 for supporting the head, neck, shoulders, and upper back of a user during selected exercises. The length of canopy 140 terminates at a lower end 142 that extends between the side rails 135 just rearward of the curved portions 114 of the roll bars 110.

With the device 100 in a first exercise position on the ground surface 160 such as shown in FIGS. 3-5, selected exercises performed using device 100 can include an abdominal exercise such as a sit-up or crunch type exercise. In the first position, the curved portions 114 of the roll bars 110 and the horizontal tubular central portion 131 of the head bar 130 serve as contact points with the ground surface 160. Prior to the start of an abdominal exercise movement, the user's head, neck, shoulders, and upper back are initially elevated from the ground surface 160 at an angle (due to the construction of head bar 130 with its connector arms 132) and fully supported by the width and length of canopy 140; these body parts are maintained in alignment and the stresses imparted thereby are evenly distributed across canopy 140 so that the user's upper body moves in unison during an exercise revolution. This is so that the spine is in proper alignment during abdominal exercise, preventing undue stress to be placed on the neck, shoulders and/or upper back.

Referring to FIG. 5, an imaginary line 175 is shown that extends between an axis along which the connecting arms 132 of the head bar 130 are oriented and the top portion of the handle bar 120; this is the first position of the device 100 on ground surface 160 for performing abdominal exercises. Obtaining this geometry is critical to ensuring that the device 100 is stable and sits flat on the ground surface 160 when in the first position for exercise.

The exercise device 100 can be placed in a second position by a user for performing different exercises, as shown in FIG. 6. Here, device 100 has been rotated from its first position into a second exercise position, such that the horizontal tubular portion 121 of the now inverted handle bar 120 serves as one contact point with the ground surface 160, and portions of a head bar 130 serve as the other contact point with the ground surface 160. The curved portions 114 of the roll bars 110 are now extended upward and away from the ground surface 160; these serve as hand placements for the user to perform push-up and dip exercises using device 100. The curved portions 114 may include grips 116 thereon for hand placement to perform a push-up or dip as well as providing traction for floor sit ups.

FIGS. 5 and 6 more clearly illustrate the lower straight portion 115 of each roll bar 110 that is integral with its curved portion 114 and connected at the second end 112 of the roll bar 110 to a corresponding connector arm 132 of the head bar 130. With the device 100 in the first position for performing abdominal exercises as shown in the side view of FIG. 5, the side rail 135 formed by the connection of the lower straight portion 115 of the roll bar 110 to the connector arm 132 can be clearly seen; these parallel side rails 135 rise from the curved portions 114 of the roll bars 110 toward the head bar 130 so as to be at an inclined upward angle relative to the ground surface 160. This inclination is set, and the stability of device 100 in the second exercise position is ensured, by determining an angle (see element 180 in FIG. 6) taken from the connector arm 132 of the head bar 130 to the lower straight portion 115 of the roll bar 110. As an example, it has been determined that an angle 180 of about 75° to 105° enables the desired inclination of the side rail 135 to be achieved, while ensuring a stable device 100 on the ground surface 160; e.g., to ensure handle bar 120 and portions of the head bar 130 (tubular central portion 131 and portions of the connector arms 132) rest evenly on the ground surface 160 when the device 100 is rotated into the second position for performing push-up and dip exercises, as shown in FIG. 6.

Figure 7:
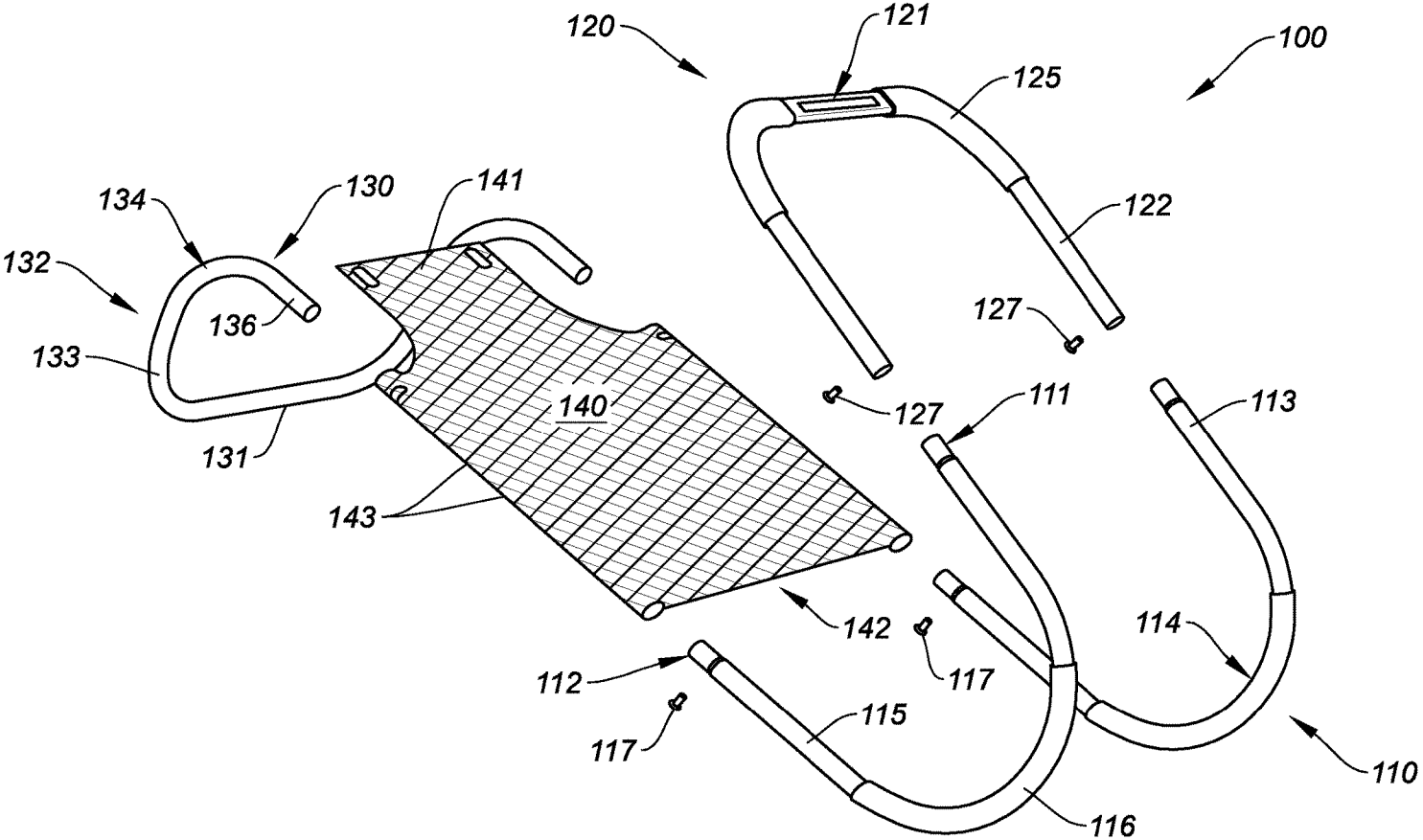
FIG. 7 is an exploded-parts view of the device of FIG. 3 to more clearly illustrate constituent components thereof.

FIG. 7 is an exploded-parts view of the device of FIG. 3 to more clearly illustrate constituent components thereof. Each roll bar 110 comprises an integral upper straight portion 113, the curved portion 114, and a lower straight portion 115 that extends rearward from the curved portion 114 at an upward inclined angle relative to the ground surface 160 (i.e., with device 100 configured on the ground surface 160 in the first exercise position for abdominal exercise movements). As shown, handle bar 110 is comprised of the horizontal tubular portion 121 at its upper end for receiving hand placements of a user. The horizontal tubular portion 121 curves downward at either end to form a pair of integral, straight tubular legs 122 in spaced parallel relation to one another, a terminating end of each straight leg 122 at the lower end of the handle bar 120 connected to a corresponding upper straight portion 113 of a roll bar 110 at its first end 111 by suitable fasteners 117.

Optionally, handle bar 120 can include a pair of foam rubber grips 125 for accommodating hand placements of the user when employing device 100 in the first exercise position for abdominal exercise. In an example, grips 125 may encircle portions of steel tubing of the handle bar 120 on both the central tubular portion 121 and straight tubular legs 122, as shown in FIG. 7. Optionally, the curved portions 114 of the roll bars 110 may include similar foam, plastic, or rubber grips 116. Grips 116 are for accommodating hand placements when the device 100 is arranged in the second push-up/dip configuration.

The head bar 130 is comprised of the horizontal central tubular portion 131 that contacts the ground surface 160 with the device 100 in the first exercise position. Central tubular portion 131 turns upward at each end to form the two integral connector arms 132 in spaced parallel relation to one another. Each connector arm 132 is further comprised of three integral portions: a first upstanding straight portion 133 extending toward the direction of the handle bar 120 at an upward angle relative to the ground surface 160, a curved portion 134 at an apex of each connector arm 132 and extending from its first upstanding straight portion 133, and a second straight portion 136 extending from the curved portion 134 at a downward angle relative to the ground surface so as to be connected to the second end 112 of a roll bar 110, more specifically to be connected to a corresponding lower straight portion 115 of a roll bar 110 by a suitable fastener 127.

In an example, each of the roll bars 110, handle bar 120, and head bar 130 may be comprised of steel tubing, with one or more portions of the tubing having a flattened profile. The steel tubing may be formed through a tube bending process with a press. Each radius bend in a piece of tubing may be formed by a custom bend die. Connections between adjacent tubular ends of these constituent parts of device 100 may be effected by sizing the respective facing ends so as to accommodate a friction or interference fit (i.e., the end of one tubing part having a diameter slightly smaller than the facing end of the other tubing part) with the connected ends secured by fasteners 117, 127, as shown.

The length of tubing encompassing the connected second ends 112 of the roll bars 110 (e.g., the lower straight portions 115) and the second straight portions 136 of the connector arms 132 are what collectively comprise the pair of straight side rails 135 that are inclined upward relative to the ground surface 160 with the device 100 in the first exercise position. As shown best in FIG. 3, these straight side rails 135 generally extend between the curved portions 114 of the roll bars 110 to terminate at the curved portions 134 arranged at the apexes of the connector arms 132 which form part of head bar 130.

The canopy 140 may be formed of a resilient material such as a polyester mesh material. The canopy 140 includes a first upper end 141 connected to the horizontal central tubular portion 131 of the head bar 130, is stretched over the curved portions 134 of the connector arms 132 and includes sides 143 which extend along the length of the side rails 135 (second straight portions 136 of the connector arms 132 and the lower straight portions 115 of the roll bars 110) and connected thereto, the canopy 140 terminating at a lower end 142 which extends between the lower straight portions 115 of the roll bars just rearward of the curved portions 114 of the roll bars 110. This material canopy 140 thus has a surface area that fully supports the head, neck, shoulders, and upper back of the user.

Figure 8:
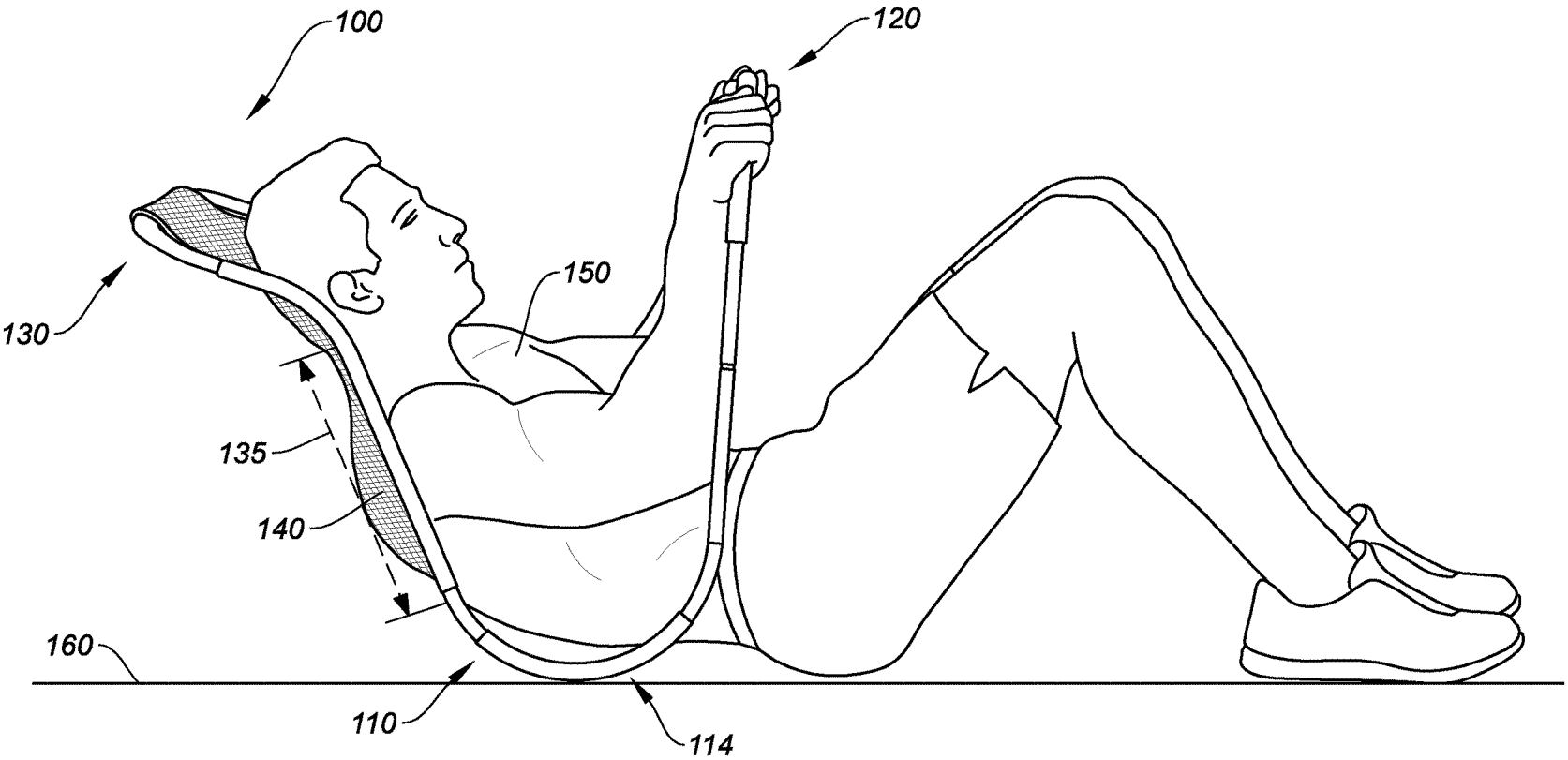
FIG. 8 illustrates a crunch exercise that may be performed using the exercise device in accordance with the example embodiment.
Figure 9:
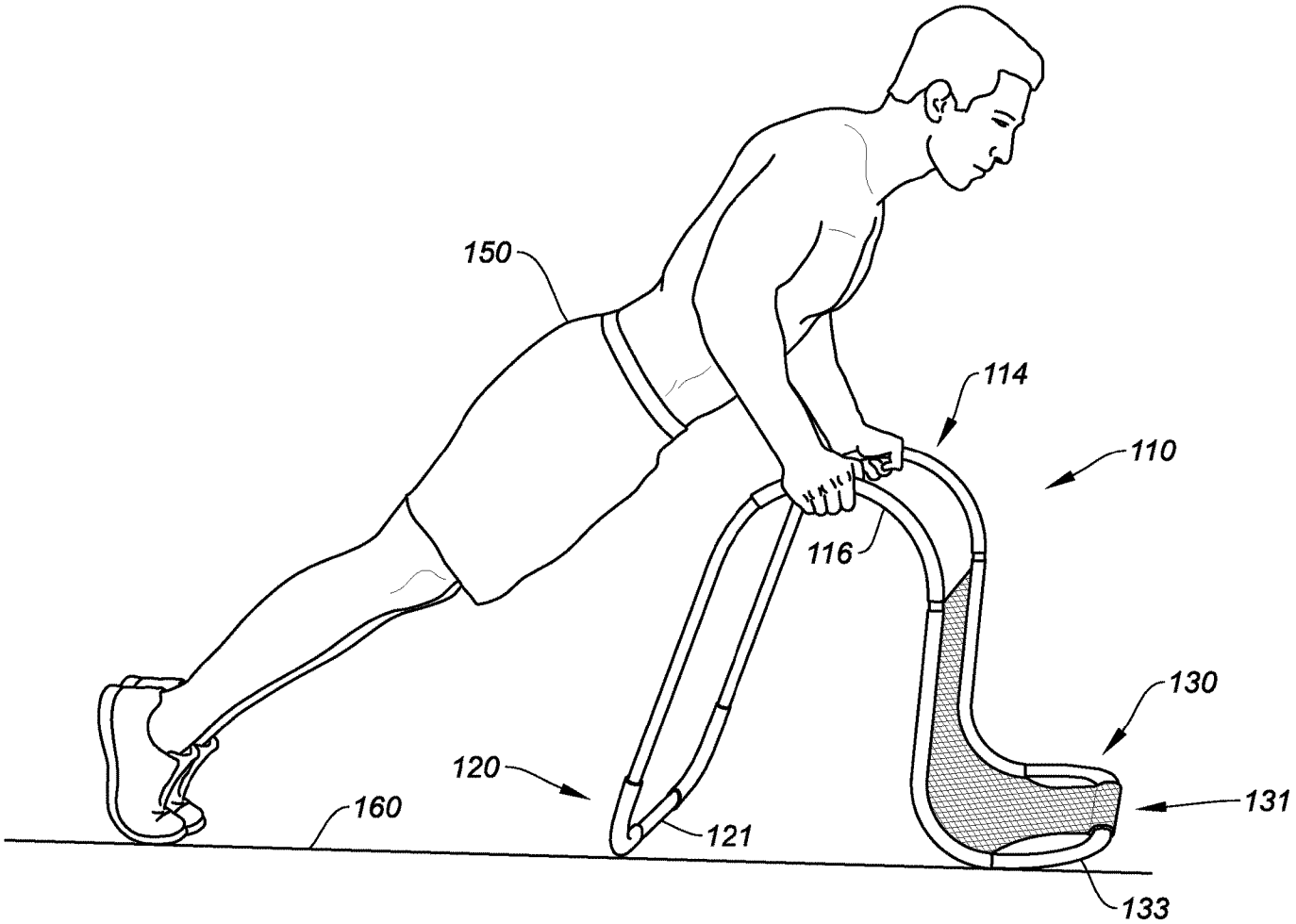
FIG. 9 illustrates a push-up exercise that may be performed using the exercise device in accordance with the example embodiment.

FIG. 8 illustrates a crunch exercise that may be performed using the exercise device in accordance with the example embodiment; FIG. 9 a push-up exercise, and FIG. 10 a dip exercise that may be performed using the exercise device in accordance with the example embodiment. As shown in FIG. 8, in the first exercise position, the curved portions 114 of the roll bars 110 contact the ground surface 160 (as well as the tubular central portion 131 of the head bar 130 (see at rest state of device 100 in FIG. 3) for initiating an abdominal exercise movement using device 100. While performing a crunch, in which a user 150 places his hands on the handle bar 120, maintains knees bent and feet placed firmly on the ground, as the user 150 rocks back and forth on the ground surface 160 via the curved portions 114 of the roll bars 110, the canopy 140 fully supports the user 150's head, neck, shoulders and upper back during the upward and/or rearward movement. The canopy 140 thus facilitates maintaining the alignment of his spine throughout the exercise movement so as not to unduly stress muscles in the neck, shoulders or upper back. This is not possible with the AB ROLLER, as only the lower part of the head and neck is supported; there is no support for the shoulders and upper back.

Figure 10:
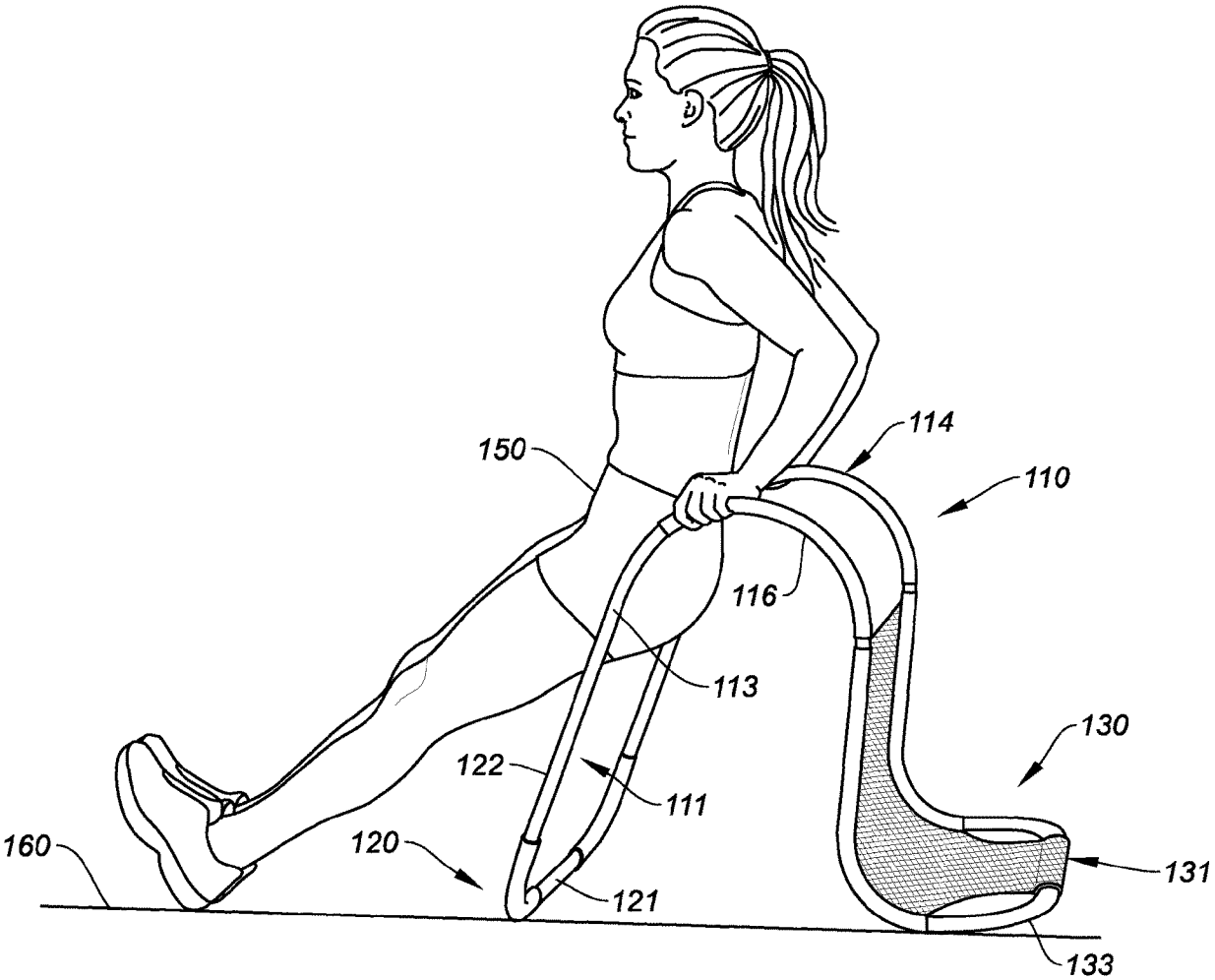
FIG. 10 illustrates a dip exercise that may be performed using the exercise device in accordance with the example embodiment.

In FIGS. 9 and 10 (showing the second push-up/dip configuration of device 100) the first upstanding portions 133 of the connector arms 132 and the tubular central portion 131 of the head bar 130 serve as a collective contact point as they lie flush to the ground surface 160. The horizontal tubular portion 121 of handle bar 120 serves as the other contact point to ground surface 160 with the device 100 in the second exercise position. The user 150 grasps the grips 116 on the curved portions 114 of the roll bars 110 to either perform an inclined push-up or dip.

The example embodiments being thus described, it will be obvious that the same may be varied in many ways. Such variations are not to be regarded as departure from the example embodiments, and all such modifications as would be obvious to one skilled in the art are intended to be included within the following claims.

We claim:

1. An exercise device configurable in a first position on a ground surface to perform abdominal exercises and in a second position on the ground surface to perform push-ups and dips, comprising:

a pair of roll bars in spaced parallel relation to one another, each roll bar having first and second ends, each roll bar including a curved portion defining a curved surface, at least a portion of the curved surface in contact with the ground surface with the device in the first position, a handle bar connected to and extending upward from the first ends of the roll bars with the device in the first position, a head bar arranged rearward of the handle bar and roll bars with the device in the first position, wherein ends of the head bar are connected to the second ends of the roll bars so as to form a pair of side rails in spaced parallel relation, the side rails rising from the roll bars toward the head bar so as to be at an inclined upward angle relative to the ground surface, the head bar having a horizontal central tubular portion extending between the second ends of the roll bars, and a continuous material canopy attached to the head bar and between the side rails and configured such that the material canopy supports the head, neck, shoulders, and upper back of a user during an abdominal exercise movement with the device in the first position, wherein with the device in the first position the user's head, neck, shoulders, and upper back are in alignment and fully supported by the material canopy as the user grasps the handle bar to initiate the abdominal exercise movement, and wherein the device is configurable in the second position where the device has been rotated relative to the ground surface so that the curved portions of the roll bars face concavely toward the ground surface for the user to employ as hand placements for push-up and dip exercises, with the handle bar and the horizontal central tubular portion of the head bar simultaneously serving as contact points for the device on the ground surface when the device is in the second position.

2. The device of claim 1, wherein each roll bar includes an integral upper straight portion, the curved portion, and a lower straight portion that extends rearward from the curved portion at an upward inclined angle relative to the ground surface when the device is in the first position.

3. The device of claim 1, wherein the handle bar has an upper and lower end, with a horizontal tubular portion for receiving hand placements of the user provided at the upper end, the horizontal tubular portion curving downward at either end to form a pair of integral, straight tubular legs in spaced parallel relation to one another, a terminating end of each straight tubular leg at the lower end of the handle bar connected to the corresponding roll bar.

4. The device of claim 1, wherein the horizontal central tubular portion of the head bar contacts the ground surface with the device in the first position and turns upward at each of two opposing ends thereof to form two integral connector arms in spaced parallel relation to one another, each connector arm including a first upstanding straight portion extending toward the direction of the handle bar at an upward angle relative to the ground surface when the device in in the first position, a curved portion at an apex thereof, and a second straight portion extending from the curved portion at a downward angle relative to the ground surface so as to be connected to the second end of the corresponding roll bar when the device is in the first position, and the connected second ends of the roll bars and second straight portions of the connector arms comprise the pair of side rails that are inclined upward relative to the ground surface with the device in the first position, the side rails extending between the head bar and the curved portions of the roll bars.

5. The device of claim 4, wherein, with the device in the second position, the handle bar includes a horizontal tubular portion that serves as one of the contact points on the ground surface, and the horizontal central tubular portion of the head bar and first upstanding straight portions of the two connector arms are arranged flush to the ground surface so as to serve as another of the contact points.

6. The device of claim 4, wherein each roll bar includes a lower straight portion at the second end thereof that is integral with the curved portion thereof, the lower straight portion extending rearward toward the head bar at an angle upward relative to the ground surface when the device is in the first position, and each side of the material canopy is attached to one of the connector arms and its correspondingly connected lower straight portion of the roll bar so that the material canopy stretches between and over the first upstanding portions, curved portions, and second straight portions of the connector arms of the head bar, and between and over the lower straight portions of the roll bars.

7. The device of claim 1, wherein an upper end of the material canopy is attached to the portion of the head bar which contacts the ground surface when the device is in the first position, portions of the material canopy are attached to each side rail so that the canopy extends across the device between and along lengths of the side rails, and a lower end of the material canopy terminates immediately rearward of the curved portions of the roll bars when the device is in the first position.

8. The device of claim 1, further comprising a pair of first grips, each first grip attached to a portion of the handle bar in spaced relationship to one another to receive hands of the user for abdominal exercises with the device in the first position.

9. The device of claim 1, further comprising a pair of second grips, each second grip encircling the curved portion of each respective roll bar to receive hands of the user for push-up and dip exercises with the device in the second position.

10. The device of claim 1, wherein the material canopy is composed of a polyester mesh material.

11. An exercise device configurable in a first position on a ground surface to perform abdominal exercises and in a second position on the ground surface to perform push-ups and dips, comprising:

a pair of roll bars in spaced parallel relation to one another, each roll bar of singular construction and including an integral upper straight portion, curved portion configured to contact the ground surface with the device in the first position, and lower straight portion that extends rearward from the curved portion at an upward inclined angle relative to the ground surface when the device is in the first position, a handle bar of singular construction extending upward from the ground surface with the device in the first position, the handle bar having an upper and lower end, with a horizontal tubular portion for receiving hand placements of a user provided at the upper end, the horizontal tubular portion curving downward at either end to form a pair of integral, straight tubular legs in spaced parallel relation to one another, a terminating end of each straight tubular leg at the lower end of the handle bar connected to the corresponding upper straight portion of each roll bar, a head bar of singular construction arranged rearward of the handle bar and roll bars when the device is in the first position, the head bar including a horizontal central tubular portion that contacts the ground surface with the device in the first position and which turns upward at each of two opposing ends thereof to form two integral connector arms in spaced parallel relation to one another, each connector arm including a first upstanding straight portion extending in a direction toward the handle bar at an upward angle to the ground surface when the device is in the first position, a curved portion at an apex of each connector arm, and a second straight portion extending from the curved portion at a downward angle relative to the ground surface when the device is in the first position, the second straight portions of the connector arms being connected to the lower straight portions of the roll bars, the lower straight portion of each roll bar being upwardly angled, the connected lower straight portions of the roll bars and second straight portions of the connector arms forming a pair of side rails in spaced parallel relation that are inclined upward from the curved portions of the roll bars to the curved portions of the connector arms of the head bar with the device in the first position, and a continuous material canopy configured to support the head, neck, shoulders, and upper back of the user during an abdominal exercise movement with the device in the first position, the material canopy having an upper end attached to the horizontal central tubular portion of the head bar, the material canopy extending across the device between the side rails and having a lower end that terminates at the curved portions of the roll bars, wherein with the device in the first position the user's head, neck, shoulders, and upper back are in alignment and fully supported by the material canopy as the user grasps the handle bar to initiate the abdominal exercise movement, and wherein the device is configurable in the second position where the device has been rotated relative to the ground surface so that the curved portions of the roll bars extend upward to face away from the ground surface for the user to employ as hand placements for push-up and dip exercises, with the handle bar and the horizontal central tubular portion of the head bar simultaneously serving as contact points for the device on the ground surface when the device is in the second position.

12. An exercise device, comprising:

a pair of roll bars in spaced parallel relation to one another, each roll bar having first and second ends, each roll bar having a curved portion configured to contact a ground surface to perform selected exercises, a handle bar connected to the roll bars' first ends, a head bar having a horizontal central tubular portion of which contacts the ground surface, the head bar including a pair of spaced arms that extend above the ground surface with ends connected to the second ends of the roll bars, forming a pair of side rails in spaced parallel relation, the side rails canted from the roll bars to the head bar at an upward angle relative to the ground surface, and a continuous material canopy attached to the head bar and side rails and configured to support the head, neck, shoulders, and upper back of a user during the selected exercises, wherein the device is configurable to enable the handle bar and the horizontal central tubular portion of the head bar to simultaneously contact the ground surface.

13. The device of claim 12, wherein the device is configurable in a first position in which the user's head, neck, shoulders, and upper back are in alignment and fully supported by the material canopy as the user grasps the handle bar to initiate an abdominal exercise movement with the head bar and curved portions configured to selectively contact the ground surface at the same time.

14. The device of claim 12, wherein the device is configurable in a second position in which the curved portions of the roll bars face concavely toward the ground surface for the user to grasp so as to perform push-up and dip exercises, the handle bar and the horizontal central tubular portion of the head bar simultaneously serving as contact points for the device on the ground surface when the device is in the second position.

15. The device of claim 12, wherein each roll bar includes an integral upper straight portion, the curved portion, and a lower straight portion that extends rearward from the curved portion at an upward angle relative to the ground surface when the device is in the first position.

16. The device of claim 12, wherein the handle bar has an upper and lower end, with a horizontal tubular portion for receiving hand placements of the user provided at the upper end, the horizontal tubular portion curving downward at either end to form a pair of integral, straight tubular legs in spaced parallel relation to one another, a terminating end of each straight tubular leg at the lower end of the handle bar connected to the corresponding roll bar.

17. The device of claim 12, wherein the horizontal central tubular portion of the head bar contacts the ground surface and turns upward at each of two opposing ends thereof to form two integral connector arms in spaced parallel relation to one another, each connector arm including a first upstanding straight portion extending toward the direction of the handle bar at an upward angle relative to the ground surface, a curved portion at an apex thereof, and a second straight portion extending from the curved portion at a downward angle relative to the ground surface so as to be connected to the second end of the corresponding roll bar, and the connected second ends of the roll bars and second straight portions of the connector arms comprise the pair of side rails that are inclined upward relative to the ground surface with the device in the first position, the side rails extending between the head bar and the curved portions of the roll bars and the head bar.

18. The device of claim 17, wherein each roll bar includes a lower straight portion at the second end thereof that is integral with the curved portion thereof, the lower straight portion extending rearward toward the head bar at an angle upward relative to the ground surface, and each side of the material canopy is attached to one of the connector arms and its correspondingly connected lower straight portion of the roll bar so that the material canopy stretches between and over the first upstanding portions, curved portions, and second straight portions of the connector arms of the head bar, and between and over the lower straight portions of the roll bars.

19. The device of claim 12, wherein an upper end of the material canopy is attached to the portion of the head bar, portions of the material canopy are attached to each side rail so that the material canopy extends across the device between the side rails, and a lower end of the material canopy terminates at the curved portions of the roll bars.

* * * * *